United States Patent [19]

Masuyama et al.

[11] Patent Number: 5,058,332

[45] Date of Patent: Oct. 22, 1991

[54] DOMED STRUCTURES HAVING RETRACTABLE ROOFS

[75] Inventors: Joe Masuyama; Koji Mikuriya; Tsuneo Takai; Shinji Chiba; Kiyoshi Hotta; Yoshinori Hamano; Katsuyuki Onishi; Koji Funahashi; Yuji Takahashi; Junichi Sugawara, all of Tokyo, Japan

[73] Assignee: Tobishima Corporation, Tokyo, Japan

[21] Appl. No.: 418,638

[22] Filed: Oct. 10, 1989

[30] Foreign Application Priority Data

Feb. 9, 1989 [JP] Japan ..... 1-30527

[51] Int. Cl.[5] ..... E04B 1/346

[52] U.S. Cl. ..... 52/66; 52/64

[58] Field of Search ..... 52/66, 63, 69, 83, 64, 52/80, 169.7, 169.1, 742

[56] References Cited

U.S. PATENT DOCUMENTS 4,738,057 4/1988 Logan ..... 52/6 X

*Primary Examiner*—David A. Scherbel
*Assistant Examiner*—Creighton Smith
*Attorney, Agent, or Firm*—Wenderoth, Lind & Ponack

[57] ABSTRACT

A domed structure having a retractable roof comprises an inside field area, a ringed structure vertically provided around said field area, two tracks laid out on the top of said ringed structure and two movable semi-vaults travelling separately on said two annular tracks, which are put one over the other when the roof is opened and are located in opposite relation to each other when the roof is formed, thereby providing a domed roof as a whole. The annular tracks laid out on the top of said ringed structure may have a gradient rising with respect to the direction of solar radiation.

11 Claims, 3 Drawing Sheets

DOMED STRUCTURES HAVING RETRACTABLE ROOFS

FIELD OF THE INVENTION

The present invention relates to a domed structure having a retractable roof.

BACKGROUND OF THE INVENTION

In recent years, there has been increased demand for attending or conducting sports, which are to be originally practiced in the open, regardless of weather conditions, especially without being subjected to the influence of rainy weather. It has also been demanded to extend the season for outdoor sports activities to all the year round. Thus, massive domed buildings having a roof have been constructed in urban areas.

However, a problem with such massive domes having a roof is that even when it does not rain, they remain so roofed that their indoor atmosphere is rather a drawback, as compared with a roofless sports field, because the roof above gives a sense of oppression to the spectators and players inside.

In view of such a problem, retractable roofs have been devised and proposed to expose the interior of the dome to the open air.

Until now have there been typically available sports fields having two types of movable roofs, one type being a completely slidable rectangular roof and the other type being a round roof movable in the manner of a camera lens shutter.

However, although used exclusively for small sports fields such as tennis courts, both types of roofs are not still applied to large sports fields such as baseball or football fields. The reasons are that, when applied to large sports fields, the known retractable roofs leave something to be desired in relation to the construction and maintenance costs, the construction techniques, the structural safety and the like.

It is therefore an object of the prsent invention to provide a domed structure having a retractable roof, which is inexpensive to construct and maintain and needs no special room for housing the retractable roof, and in which the retractable roof is of sufficient structural strength and safety when applied to a large sports field and is smoothly movable with an increased opening ratio.

SUMMARY OF THE INVENTION

According to one aspect of the present invention, there is provided a domed structure having a retractable roof, which comprises in combination:

an inside field area, a ringed structure vertically provided around the field area, two tracks laid out on the top of the ringed structure, and two movable semi-vaults travelling separately on the two annular tracks, which are put one over the other when the roof is opened and are positioned in opposite relation to each other when the roof is formed, thereby providing a domed roof as a whole.

According to another aspect of the present invention, there is provided a domed structure having a retractable roof, which comprises in combination:

an inside field area, a ringed structure vertically provided around the field area, two tracks laid out on the top of the said ringed structure, and two movable semi-vaults travelling separately on the two annular tracks, which are put one over the other when the roof is opened and are positioned in opposite relation to each other when the roof is formed, thereby providing a domed roof as a whole, wherein the annular tracks laid out on the top of the ringed structure have a gradient rising with respect to the direction of solar radiation.

BRIEF DESCRIPTION OF THE DRAWINGS

Embodiments of the domed structure having a retractable roof according to the present invention will now be explained with reference to the accompanying drawings, which are given for the purpose of illustration alone, and in which.

DESCRIPTION OF PREFERRED EMBODIMENTS

Figure 1:
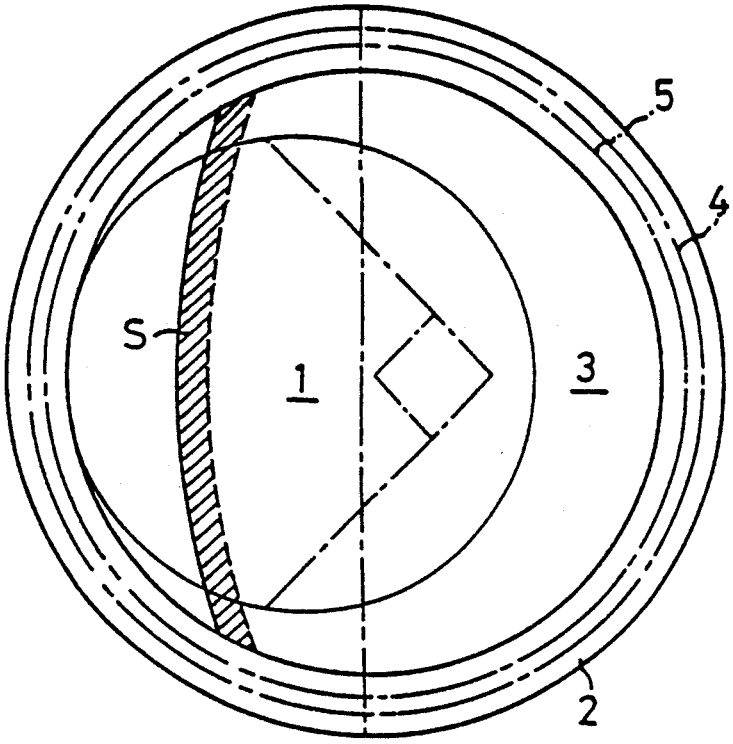
FIG. 1 is a schematic plan view of the domed structure having a retractable roof according to the present invention, from which movable split vaults are removed.

Referring to the drawings, an inside field area is generally shown at 1.

The field area 1 is designed to be used as various sports fields, such as baseball, track and soccer fields.

Figures 5, 6:
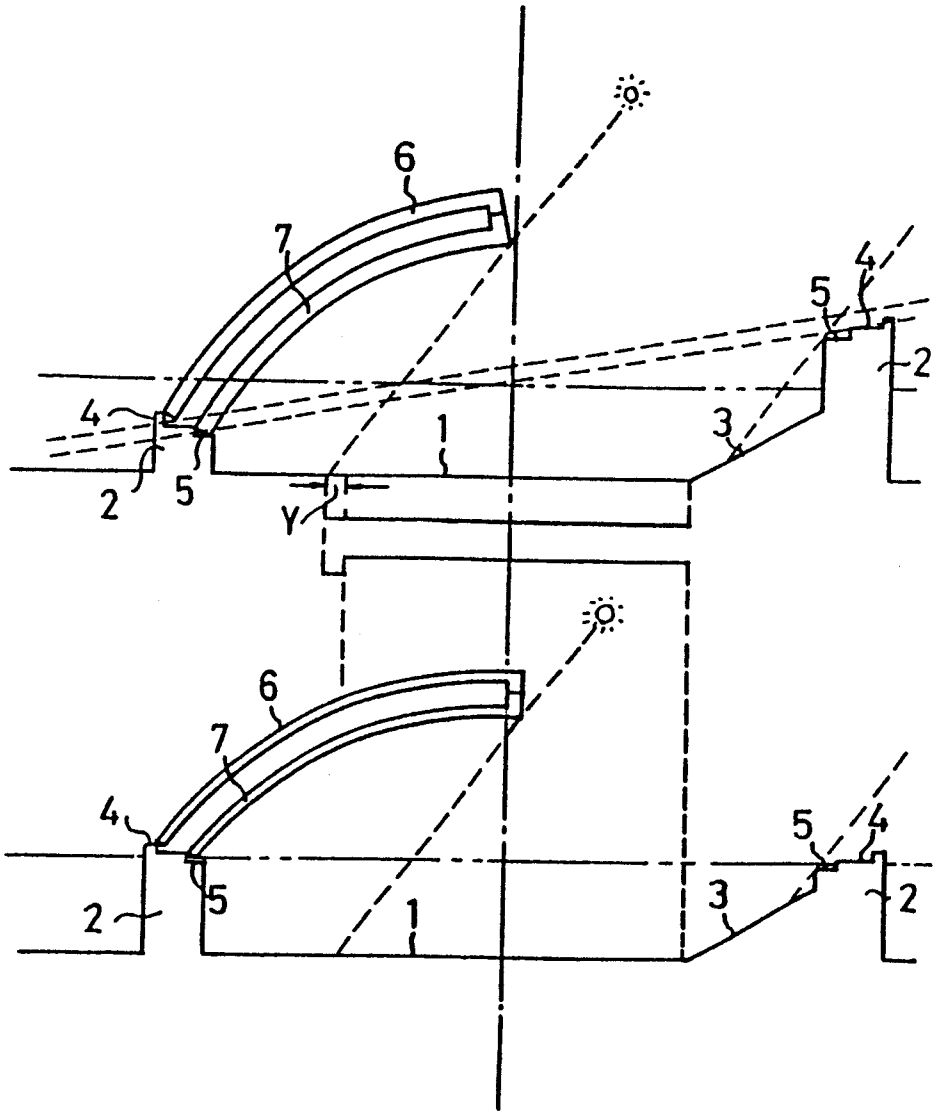
FIG. 5 is a schematic section illustrating a second aspect of the present invention.
FIG. 6 is a schematic section illustrating the first aspect of the present invention.

A ringed strusture 2 is erected up around the field area 1, and a number of seats 3 for spectators are provided extending from the ringed structure 2 toward the field area 1, making use of a slope having a falling gradient (see FIGS. 1, 5 and 6).

Placed on the top of the ringed structure 2 in its widthwise direction are two, or a pair, of annular tracks 4 and 5.

Reference numerals 6 and 7 stand for movable split roof elements in the form of semi-vaults having at their lower ends driving means such as driving wheels, which are designed to travel on the annular tracks 4 and 5, thereby opening or closing the roof above the structure.

It is noted that one feature of the present invention is that the two split roof elements 6 and 7 are both movable.

Figure 2:
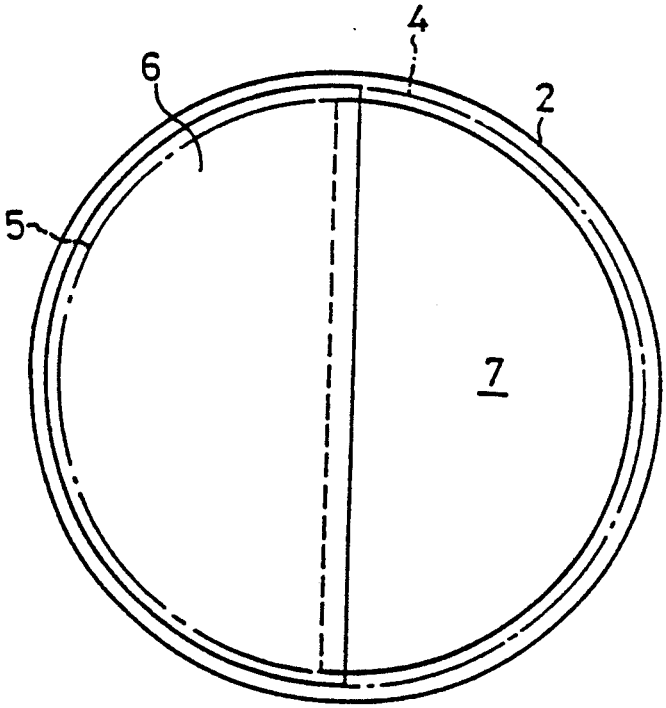
FIG. 2 is a plan view of the domed structure of FIG. 1, with the roof retracted into a closed position.
Figure 3:
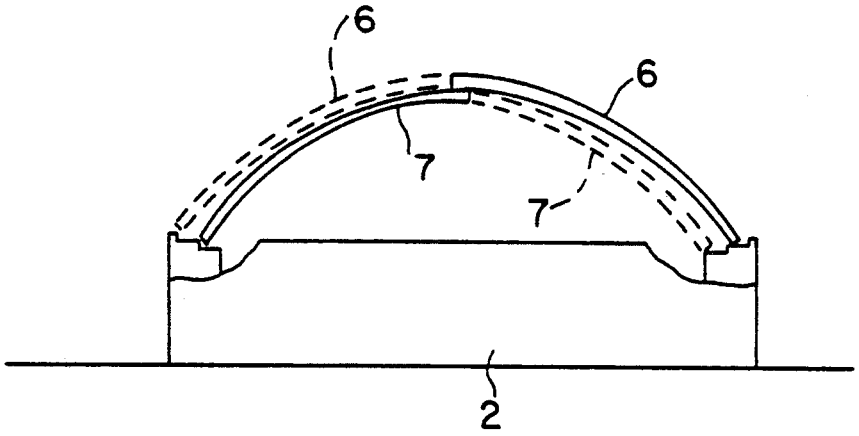
FIG. 3 is a schematic section of FIG. 2, FIGS. 4(A), (B), (C) and (D) are schematic views of the roof retracted into various positions.

As can be seen from FIGS. 2 and 3, the movable semi-vaulted roof element 6 is designed to travel on the outer annular track 4 placed on the top of the ringed structure 2, while the movable roof element 7 is adapted to move on the inner annular track 5.

Thus, the two semi-vaulted roof elements finally form a domed or substantially bowl-like roof.

Reference will now be made to the movement of the split roof elements 6 and 7 to form such a domed roof.

It is understood that the movable split semi-vaults 6 and 7 are designed such that they are positioned in opposite relation to each other to finally form the domed roof. For that purpose, the movable roof element 7 placed inside the movable roof element 6 superposed thereon is first moved along the annular track 5.

That element 7 is moved further to a position shown in FIG. 2 to seal together the junction of the roof elements 6 and 7, thereby providing a domed roof which as a whole assumes a substantially bowl-like form.

Referring then to the operation for opening the roof, the movable roof element 7 may be moved back from the position shown in FIG. 2 along the annular track 5 to the position where it is placed inside the movable roof element 6 to be superposed thereon, thereby providing a retractable dome having an opening ratio of about 65%.

According to the present invention, an opening ratio of 65% is achievable in the field area 1. Due to the specific feature of the present invention that the two split roof elements 6 and 7 are both movable, however, if they are moved while aligning the resulting opening with the direction of solar radiation, it is then possible to obtain an insolation higher than that obtained at an actual opening ratio.

Figure 4A:
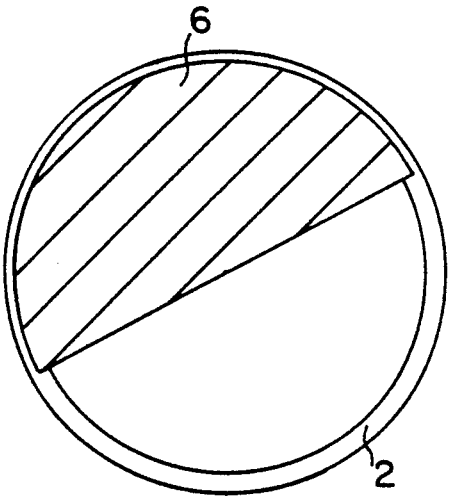
Figure 4B:
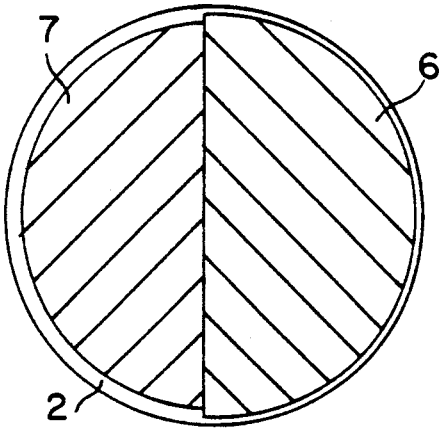
Figure 4C:
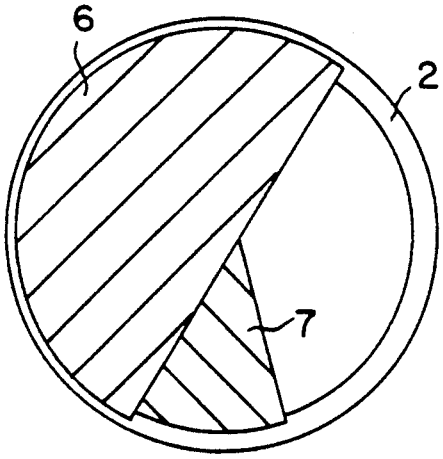
Figure 4D:
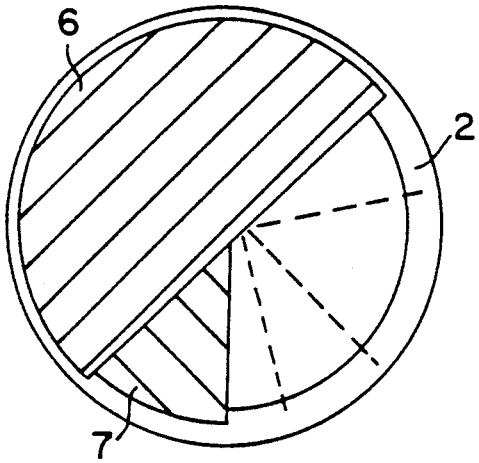

Moreover, if the position and degree of opening are varied by moving said two split roof elements 6 and 7 as shown in FIGS. 4(A), (C) and (D), it is then possible to impart more attractable performance effects to various events and games.

The second embodiment of the present invention will now be explained.

According to the second embodiment of the present invention, the top of a ringed structure 2 is tilted with a gradient rising with respect to the direction of solar radiation, as illustrated in FIG. 5.

In this arrangement, two annular tracks 4 and 5 laid out on that top are tilted with a gradient rising with respect to the direction of solar radiation, correspondingly.

Thus, the direction of opening of the domed roof can be aligned with the direction of solar radiation so that, as illustrated by a hatched zone S in FIG. 1, the width of the incoming sunlight can be extended as much as the hatched zone S or a width Y shown in FIG. 5.

It is noted that it is only the top of the ringed structure 2 and the annular tracks 4 and 5 placed thereon which are tilted with a rising gradient, and that the field area 1 remains horizontal as usual. Although an actual opening ratio is about 65% as illustrated in FIG. 1, the sunlight is incident on at least 95% of the field area 1, a figure that is much higher than the actual opening ratio.

The domed structure having a retractable roof according to the present invention is constructed as mentioned above.

With the domed structure according to the present invention, it is possible to attend or conduct outdoor sports in the natural environment when the weather is fine and in an indoor environment provided by closing the roof in case of wet weather.

With the two movable split roof elements each in the form of a semi-vault, it is possible to increase the opening ratio of the structure, since they are housed one over the other.

Further, the two split roof elements can be freely and separately moved on the annular tracks to provide shadow or sunny spots at player's or spectator's request.

The two split roof elements can also be freely moved to provide a windbreak depending upon the direction of wind or for satisfactory natural ventilation.

Still further, the two split roof elements can be freely displaced to vary the position and degree of opening of the domed roof.

What is claimed is:

1. A structure having a retractable roof, comprising:
a substantially circular vertically extending wall structure;
a substantially horizontal field area inside said wall structure;
a first circular track on top of said wall structure;
a second circular track on top of said wall structure, said second circular track having a smaller diameter than said first circular track and being disposed inside of said first circular track;
a first semi-vault roof element disposed on said first circular track for movement thereon; and
a second semi-vault roof element disposed on said second circular track for movement thereon;
wherein said semi-vault roof elements can be moved to a position whereat said roof elements together form a vaulted roof over said horizontal field area.

2. A structure having a retractable roof, comprising:
a substantially circular vertically extending wall structure;
a substantially horizontal field area inside said wall structure;
a first circular track on top of said wall structure;
a second circular track on top of said wall structure, said second circular track having a smaller diameter than said first circular track and being disposed inside of said first circular track;
a first semi-vault roof element disposed on said first circular track for movement thereon; and
a second semi-vault roof element disposed on said second circular track for movement thereon;
wherein said semi-vault roof elements can be moved to a position whereat said roof elements together form a vaulted roof over said horizontal field area; and
wherein said first and second circular tracks have a gradient with respect to said horizontal field area such that both said circular tracks on one side of said wall structure are at a higher position than said circular tracks on the opposite side of said wall structure, said higher position being directed toward a direction of solar radiation.

3. The structure as set forth in claim 1 or 2, wherein:
said substantially circular vertically extending wall structure has a portion sloping towards said horizontal field area, said portion including a plurality of seats for spectators.

4. The structure as set forth in claim 1 or 2, wherein:
said substantially circular vertically extending wall structure has a top portion comprising a first surface on which is disposed said first circular track and a second surface diametrically inside said first surface on which is disposed said second circular track.

5. The structure as set forth in claim 4, wherein:
said second surface is lower than said first surface.

6. The structure as set forth in claim 1 or 2, wherein:
each said semi-vault has, at a lower end thereof, driving means for moving said semi-vault on its respective said circular track.

7. The structure as set forth in claim 1 or 2, wherein each said semi-vault is a half dome, said half domes together defining said vaulted roof as a dome.

8. A structure having a retractable roof, comprising:

a substantially circular vertically extending wall structure;

a substantially horizontal field area inside said wall structure;

a first circular track on top of said wall structure;

a second circular track on top of said wall structure, said second circular track having a smaller diameter than said first circular track and being disposed inside of said first circular track;

an openable dome roof disposed on said substantially circular wall structure, said dome roof comprising a first half dome disposed on said first circular track for movement thereon and a second half dome disposed on said second circular track for movement thereon.

9. The structure as set forth in claim 8, wherein said dome roof consists of said first and second half dome.

10. The structure as set forth in claim 8, wherein said second circular track extends substantially 360° about said circular wall structure such that said second half dome can be moved at least up to substantially 180° about said circular wall structure.

11. The structure as set forth in claim 8, wherein said circular wall structure is higher at one side thereof than at an opposite side thereof.

* * * * *